US010686246B2

(12) United States Patent
Park et al.

(10) Patent No.: US 10,686,246 B2
(45) Date of Patent: Jun. 16, 2020

(54) DISPLAY MODULE INCLUDING ANTENNA

(71) Applicant: Samsung Electronics Co., Ltd., Gyeonggi-do (KR)

(72) Inventors: Soon Park, Gyeonggi-do (KR); Jong-Hyun Park, Gyeonggi-do (KR); Yong Heo, Seoul (KR)

(73) Assignee: Samsung Electronics Co., Ltd., Samsung-ro, Yeongtong-gu, Suwon-si, Gyeonggi-do (KR)

( * ) Notice: Subject to any disclaimer, the term of this patent is extended or adjusted under 35 U.S.C. 154(b) by 255 days.

(21) Appl. No.: 14/303,752

(22) Filed: Jun. 13, 2014

(65) Prior Publication Data

US 2015/0123860 A1 May 7, 2015

(30) Foreign Application Priority Data

Nov. 1, 2013 (KR) ..... 10-2013-0132468

(51) Int. Cl.

| | |
|---|---|
| ***H01Q 1/24*** | (2006.01) |
| ***H01Q 1/22*** | (2006.01) |
| ***H01Q 1/52*** | (2006.01) |
| *H01Q 17/00* | (2006.01) |

(52) U.S. Cl.

CPC ..... *H01Q 1/22* (2013.01); *H01Q 1/526* (2013.01); *H01Q 1/243* (2013.01); *H01Q 17/004* (2013.01)

(58) Field of Classification Search

CPC ..... H01Q 1/22; H01Q 1/526; H01Q 1/243; H01Q 17/004

USPC ..... 343/720

See application file for complete search history.

(56) References Cited

U.S. PATENT DOCUMENTS 6,661,563 B2 * 12/2003 Hayashi ..... G09F 9/372 345/107
2004/0027296 A1 * 2/2004 Gerber ..... H01Q 1/243 343/702
2005/0264460 A1 * 12/2005 Sunaga ..... G06K 7/10316 343/702
2006/0098412 A1 * 5/2006 Kim ..... H05K 7/20963 361/704
2007/0069961 A1 * 3/2007 Akiho ..... H01Q 1/243 343/702

(Continued)

FOREIGN PATENT DOCUMENTS

EP 2 712 053 A1 3/2014
JP 2010-102531 A 5/2010

(Continued)

OTHER PUBLICATIONS

European Search Report dated Nov. 29, 2018.

(Continued)

*Primary Examiner* — Dieu Hien T Duong
*Assistant Examiner* — Bamidele A Jegede
(74) *Attorney, Agent, or Firm* — Cha & Reiter, LLC

(57) ABSTRACT

Disclosed is a display module that includes at least one antenna, for use in an electronic device. The display module includes a display panel, and a magnetic sheet disposed under the display panel. The at least one antenna is disposed above the magnetic sheet. The magnetic sheet may serve to prevent degradation of electronic device performance by preventing the generation of eddy currents on a nearby metal part of the device.

13 Claims, 13 Drawing Sheets

(56) References Cited

U.S. PATENT DOCUMENTS

2007/0085838 A1* 4/2007 Ricks ..... G06F 3/0412 345/173
2007/0200963 A1* 8/2007 Shin ..... H04N 5/645 348/836
2007/0287503 A1* 12/2007 Ying ..... H01Q 1/1271 455/566
2009/0243806 A1* 10/2009 Takahashi ..... G06K 7/0008 340/10.1
2010/0257725 A1* 10/2010 Akiho ..... C01G 49/0018 29/600
2010/0261445 A1* 10/2010 Harrysson ..... H01Q 1/1271 455/129
2010/0315389 A1* 12/2010 Sorrell ..... H01Q 1/22 345/204
2011/0267238 A1* 11/2011 Nekozuka ..... H01Q 1/243 343/702
2012/0133597 A1 5/2012 Chen
2012/0162033 A1* 6/2012 Togashi ..... H01Q 1/243 343/720
2012/0262397 A1* 10/2012 Im ..... H04M 1/00 345/173
2012/0327327 A1* 12/2012 Joo ..... H05K 1/189 349/58
2013/0002517 A1* 1/2013 Pascolini ..... H01Q 1/2266 343/878
2013/0088453 A1* 4/2013 Park ..... G06F 1/1643 345/173
2013/0147728 A1* 6/2013 Lee ..... G06F 3/041 345/173
2013/0176179 A1* 7/2013 Park ..... H01Q 1/243 343/702
2013/0217295 A1* 8/2013 Karunaratne ..... A63H 33/086 446/124
2013/0229362 A1* 9/2013 Liu ..... G06F 3/041 345/173
2013/0250504 A1* 9/2013 Choi ..... G06F 1/203 361/679.26
2014/0043248 A1* 2/2014 Yeh ..... H01Q 7/00 345/173
2014/0091758 A1 4/2014 Hidaka et al.
2015/0085344 A1* 3/2015 Li ..... H01Q 1/44 359/296

FOREIGN PATENT DOCUMENTS

KR 10-2013-0107010 A 10/2013
WO 2012/172813 A1 12/2012
WO WO2013115616 A1 * 8/2013 ..... G06F 1/1684

OTHER PUBLICATIONS

Korean Search Report dated Sep. 23, 2019.
European Search Report dated Nov. 12, 2019.
Korean Notice of Patent Grant dated Mar. 30, 2020.

* cited by examiner

DISPLAY MODULE INCLUDING ANTENNA

CLAIM OF PRIORITY

This application claims priority under 35 U.S.C. § 119 to an application filed in the Korean Intellectual Property Office on Nov. 1, 2013 and assigned Serial No. 10-2013-0132468, the contents of which are incorporated herein by reference.

BACKGROUND

1. Technical Field

The present disclosure relates to generally to electronic devices and more particularly to a display module including an antenna with improved antenna performance.

2. Description of the Related Art

With recent advances in telecommunications, user devices (electronic devices such as such as smartphones, cellular phones, electronic organizers, and personal digital assistants (PDAs)), are becoming necessities in modern society and an important means for information delivery in a rapidly changing environment. Such user devices provide a convenient working environment for users through a graphical user interface environment using a touchscreen and various web-based multimedia.

Recent handheld user devices include a near field antenna to perform a near field communication (NFC) function. The NFC antenna is packaged within the device housing along with many other electronic components providing various other functions. For example, a typical user device includes a stereo speaker module to provide a music listening function using stereo sound, a camera module to provide an image capturing function, a communication module to provide a communication function with other electronic devices through networks, etc. With the desire to provide thin and lightweight portable devices, an ongoing design challenge exists to package as many desired electronic components as possible within a limited space, while minimizing interference among the components to prevent degradation in performance.

SUMMARY

An aspect of the present disclosure is to provide a display module including an antenna with a configuration for improving antenna and electronic device performance (e.g., reduced interference).

Another aspect of the present disclosure is to provide a display module for allowing for a slim design of an electronic device.

In an embodiment, a display module includes a display panel, a magnetic sheet disposed under the display panel, and at least one antenna disposed above the magnetic sheet.

The magnetic sheet may serve to prevent degradation of electronic device performance by preventing the generation of eddy currents on a nearby metal part of the device.

In another embodiment, a display module includes a display panel, an antenna sheet disposed under the display panel and including at least one antenna, and a composite sheet disposed under the antenna sheet. The composite sheet forms different phases physically according to a combination of various materials to provide a plurality of functions.

BRIEF DESCRIPTION OF THE DRAWINGS

The above and other aspects, features and advantages of the presently disclosed technology will become more apparent from the following detailed description when taken in conjunction with the accompanying drawings in which like reference numerals depict like components or features, wherein.

DETAILED DESCRIPTION

Figure 1:
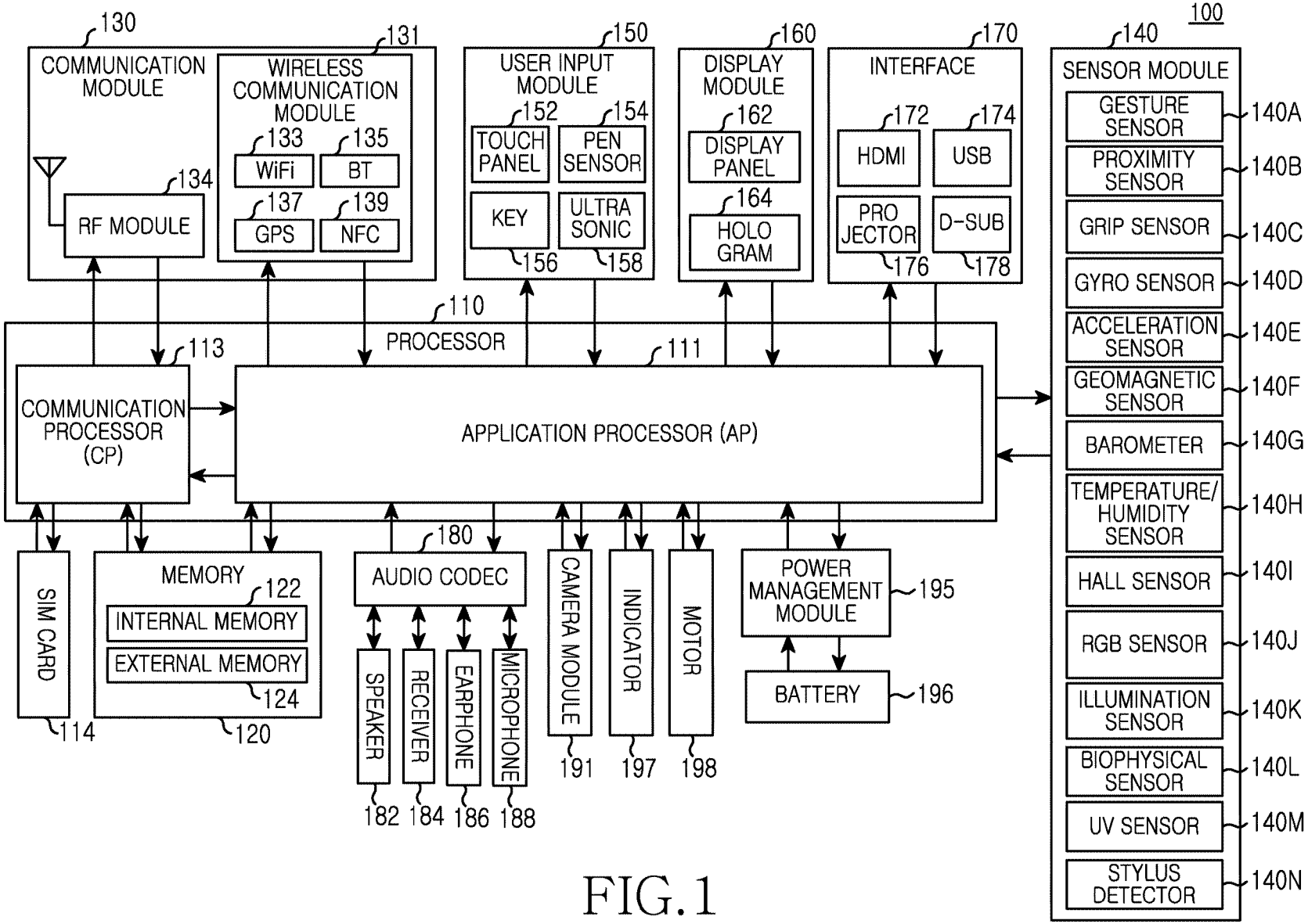
FIG. 1 is a block diagram illustrating a hardware configuration according to various embodiments of the present disclosure.

Exemplary embodiments of the present invention will be described herein below with reference to the accompanying drawings. Although example embodiments are illustrated in the figures and described throughout, it should be understood that many alternative forms, modifications, and embodiments are possible. However, it will be understood that the present invention is not limited to specific embodiments and includes all modifications, equivalents, and substitutions falling within the spirit and scope of the present invention. In figures, similar numerals are used to denote similar members.

The electronic device according to various embodiments of the present disclosure may be a device having a communication function. Examples of the electronic device include a smart phone, a tablet personal computer, a mobile phone, a video telephone, an e-book reader, a desktop personal computer, a personal digital assistant, a portable multimedia player, a MP3 player, a mobile medical device, a camera, or a wearable device (for example, a head-mounted-device (HMD) such as electronic glasses, electronic clothing, an electronic bracelet, an electronic necklace, an electronic accessory, or a smart watch).

According to an embodiment, the electronic device may be a smart home appliance having a communication function. As a smart home appliance, the electronic device may be. e.g., a television, a digital video desk (DVD) player, a stereo, a refrigerator, an air-conditioner, a cleaner, an oven, a microwave oven, a washing machine, an air cleaner, a set-top box, a TV box (e.g., a Samsung HomeSync™ type box), a game console, an electronic dictionary, a camcorder, or a digital photo frame.

According to an embodiment, the electronic device may be any of various types of medical devices (for example, MRA (magnetic resonance angiography), MRI (magnetic resonance imaging), CT (computed tomography), an imaging device, or an ultrasound imaging device), a navigation device, a GPS receiver, an event data recorder (EDR), a flight data recorder (FDR), a vehicle infotainment device, a ship electronic device (for example, a ship navigation device or a gyro-compass device), an avionics device, or a security device.

According to an embodiment, the electronic device may be any of a furniture-integrated device including a communication function, a part of a building/structure, an electronic board, an electronic signature receiving device, a protector, or various types of meters (for example, water, electricity, gas, or radio wave). The electronic device according to the present disclosure may be a combination of one or more of the above-described devices. In addition, it is apparent to those skilled in the art that the electronic device according to the present disclosure is not limited to the above-described devices.

Herein, when a first layer, sheet of material, component, etc. of an electronic device is said to be "above" or "on" a second layer, sheet, component, etc., the first layer is disposed at an upper side of the second layer, where the electronic device is assumed to be oriented with its screen facing up. Although the first layer is above the second layer, an intermediate layer may exist between the first and second layers. In the same assumed orientation of the electronic device, when a second layer or sheet is said to be "under" a first layer, the second layer is disposed beneath a lower side of the first layer. When the second layer is said to be disposed under the first layer, the second layer may be directly below the first layer, e.g., by being attached to the lower side of the first layer, or, it may be disposed beneath an intermediate layer that is directly below the first layer.

FIG. 1 is a functional block diagram illustrating example hardware of an electronic device, 100, according to various embodiments of the present disclosure. As illustrated, device 100 may include at least one processor 110, a subscriber identification module (SIM) card 114, a memory 120, a communication module 130, a sensor module 140, an user input module 150, a display module 160, an interface 170, an audio codec 180, a camera module 191, a power management module 195, a battery 196, an indicator 197, and a motor 198.

The processor 110 may include at least one application processor (AP) 111 or at least one communication processor (CP) 113. Although the AP 111 and the CP 113 are illustrated as being included in the processor 110, the AP 111 and the CP 113 may be respectively included in different IC packages. The AP 111 and the CP 113 may be included in one IC package.

The AP 111 may execute an operating system or an application program to control hardware or software components connected to the AP 111 and process or calculate various data including multimedia data. The AP 111 may be implemented using, for example, a system-on-chip (SoC). The processor 110 may further include a graphic processing unit (GPU) (not illustrated).

The CP 113 may manage data links for communication between device 100 and other devices communicatively connected to device 100 through networks and perform conversion of communication protocols. The CP 113 may be implemented using, for example, a system-on-chip (SoC). The CP 113 may perform at least one multimedia control function. The CP 113 may perform identification and authentication of a terminal within a communication network using, for example, a subscriber identity module (e.g., SIM card 114). The CP 113 may provide services, such as a voice call service, a video call service, a text message service, or a packet data service to a user.

The CP 113 may control the data transmission and reception of the communication module 130. Although the CP 113, the power management module 195, and the memory 120 are each illustrated as being separate from the AP 111 in FIG. 1, the AP 111 may be implemented to include at least one of these components.

The AP 111 or the CP 113 may load a command or data received from at least one of a non-volatile memory connected thereto and another component into a volatile memory and process the command or the data. The AP 111 or the CP 113 may store data received from or generated by at least one of other components in the non-volatile memory.

The SIM card 114 may be a card implementing a subscriber identity module or may be inserted into a slot formed in a specific position of the hardware of device 100. The SIM card 114 may include unique identification information (for example, integrated circuit card identifier (ICCID)) or subscriber information (e.g., international mobile subscriber identity (IMSI)).

The memory 120 may include a built-in memory 122 and/or an external memory 124. The built-in memory 122 may include at least one of, for example, a volatile memory (for example, DRAM (dynamic RAM), SRAM (static RAM), or SDRAM (synchronous dynamic RAM)) and a non-volatile memory (for example, OTPROM (one time programmable ROM), PROM (programmable ROM), EPROM (erasable and programmable ROM), EEPROM (electrically erasable and programmable ROM), a mask ROM, a flash ROM, a NAND flash memory, or a NOR flash memory). The built-in memory 122 may have a solid state drive (SSD) type. The external memory 124 may further include, for example, a CF (compact flash) memory, a SD (secure digital) memory, a Micro-SD (micro secure digital) memory, a Mini-SD (mini secure digital), an xD (extreme digital) memory, or a memory stick.

The communication module 130 may include a wireless communication module 131 and an RF module 134. The wireless communication module 131 may include, for example, a Wi-Fi module 133, a Bluetooth (BT) module 135, a GPS module 137 and/or a near field communication (NFC) module 139. For example, the wireless communication module 131 may provide a wireless communication function by using radio frequencies. Additionally or alternatively, the wireless communication module 131 may include a network interface (for example, LAN card) or a modem which connects the hardware 100 to a network (for example, Internet, LAN (local area network), WAN (wire area network), telecommunication network, cellular network, satellite network or POTS (plain old telephone service). The NFC module 139 may include a dedicated antenna such as a coil antenna (e.g., antenna 230 shown in FIG. 2).

The RF module 134 may perform transmission and reception of data, for example, transmission and reception of RF signals or requested electronic signals. Although not illustrated, the RF module 134 may include, for example, a transceiver, a power amp module (PAM), a frequency filter, or a low noise amplifier (LNA). The RF module 134 may further include a component for transmitting and receiving electromagnetic waves in free space for wireless communication, for example, a conductor or a conductive line.

The sensor module 140 may include at least one of the following: a gesture sensor 140A, a proximity sensor 140B, a grip sensor 140C, a gyro sensor 140D, an acceleration sensor 140E, a geomagnetic sensor 140F, a barometer 140G, a temperature/humidity sensor 140H, a hall sensor 140I, a RGB (red-green-blue) sensor 140J, a illumination sensor 140K, a biophysical sensor 140L, an ultra violet (UV) sensor 140M, and a stylus detector 140N. The sensor module 140 may measure a physical amount or detect the operating state of hardware and convert measured or detected information into electrical signals. Additionally/alternatively, the sensor module 140 may include, for example, an E-nose sensor, an electromyography (EMG) sensor, an electroencephalogram (EEG) sensor, an electrocardiogram (ECG) sensor and/or a fingerprint sensor (all not illustrated). The sensor module 140 may further include a control circuit for controlling at least one sensor included therein.

The user input module 150 may include a touch panel 152, a (digital) pen sensor (for example, a digitizer 154), a key 156, or an ultrasonic-wave input device 158. The touch panel 152 may recognize a touch input using at least one method of, for example, a capacitive method, a pressure-sensitive method, an infrared method, and an ultrasonic-wave method. The touch panel 152 may further include a controller (not illustrated). In the case of the capacitive method, not only direct touch but also proximity recognition is possible. The touch panel 152 may further include a tactile layer. In this case, the touch panel 152 may provide a touch response to a user.

The (digital) pen sensor 154 may be implemented using a separate sheet for recognition and at least one method of a capacitive method, a pressure-sensitive method, an infrared method, or an ultrasonic-wave method identical to or similar as a method for receiving a touch input from a user. The key 156 may be embodied as e.g., a keypad or a touch key. The ultrasonic-wave input device 158 is a device for detecting micro sound wave and identifying data through a pen for generating ultrasonic signals in the electronic device. The hardware of device 100 may receive a user input from an external device (e.g., a network, a computer, or a server) connected thereto using the communication module 130.

The display module 160 may include a display panel 162 and a hologram 164. Display panel 162 may be, for example, a liquid-crystal display (LCD) panel, a thin film transistor liquid crystal display (TFT LCD) panel, a passive-matrix organic light-emitting diode (PM-OLED) panel, or active-matrix organic light-emitting diode (AM-OLED) panel. Display panel 162 may be implemented to be, e.g., flexible, transparent, or wearable. Display panel 162 may be integrated into one module with the touch panel 152. The hologram 164 may enable 3D images to be displayed in space using optical interference. The display module 160 may further include a control circuit for display panel 162 and the hologram 164.

The interface 170 may include, for example, a high-definition multimedia interface (HDMI) 172, a universal serial bus (USB) 174, a projector 176 or a D-subminiature (D-sub) 178. Additionally or alternatively, the interface 170 may include a secure digital (SD)/multi-media card (MMC) interface or an infrared data association (IrDA) interface.

The audio codec 180 may perform conversion between voice and electrical signals. The audio codec 180 may perform conversion of voice information input or output through, for example, the speaker 182, a receiver 184, an earphone 186, or the microphone 188.

The camera module 191 is a device for capturing an image and moving images. The camera module 191 may include at least one image sensor (e.g., a front lens or a rear lens) or an image signal processor (not illustrated) according to an embodiment.

The power management module 195 may manage power of device 100. Although not illustrated, the power management module 195 may include, for example, a power management integrated circuit (PMIC), a charger integrated circuit, or a battery fuel gauge.

The PMIC may be mounted within, for example, an integrated circuit or an SoC semiconductor. A charging method may be a wired or wireless charging method. The charger IC may charge a battery and prevent the inflow of overvoltage or overcurrent from a charger. The charger IC may employ at least one of a wired charging method or a wireless charging method. The wireless charging method may include, for example, a magnetic resonance method, an electromagnetic induction method, or an electromagnetic wave method, and an additional circuit for wireless charging, for example, a coil loop, a resonance circuit, or a rectifier may be included.

A battery gate may measure, for example, an amount of power remaining or a voltage, a current, or a temperature during charging for the battery 196. The battery 196 may generate electricity and supply power and may be, for example, a rechargeable battery.

The indicator 197 may represent a specific state of the device 100 or a component thereof (for example, AP 111), for example, a booting state, a message state, or a charge state. The motor 198 may convert electrical signals into mechanical vibration. Although not illustrated, a micro control unit (MCU) may control the sensor module 140.

Although not illustrated, device 100 may include a processing device (for example, a graphical processing unit (GPU)) for supporting mobile TV services. The processing device for supporting mobile TV services may process media data according to a standard, such as digital multimedia broadcasting (DMB), digital video broadcasting (DVB), or media flow.

The names of the above-described components of the hardware according to an embodiment may vary according to the types of hardware. An electronic device according to an embodiment may be configured by including at least some of the above-described components. Some components may be omitted, or additional other components may be further included in the hardware. When some of the components of the hardware according to the embodiment are combined into one entity, the one entity may perform the functions of the components before combination.

Figure 2:
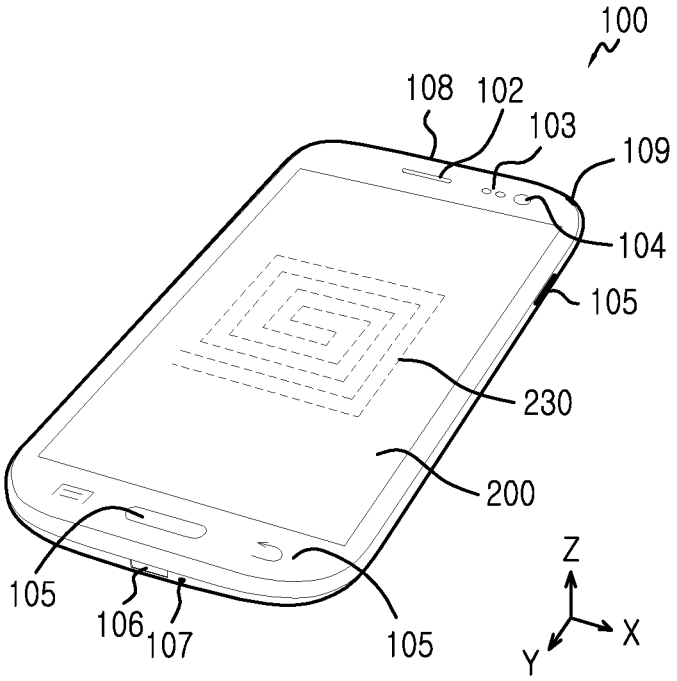
FIG. 2 is a perspective view illustrating an electronic device according to various embodiments of the present disclosure.

FIG. 2 is a perspective view illustrating an electronic device 100 according to an example. In FIG. 2 as well as subsequent figures herein, components of the same names as those described in connection FIG. 1, but referred to with different reference numerals, may have the same functionality as described hereinabove.

Referring to FIG. 2, the electronic device 100 may include a display module 200, a speaker 102, at least one sensor module 103, a camera module 104, at least one key 105, an external port 106 (e.g., interface 170), a microphone 107, a jack 108, and an antenna 109.

The display module 200 displays images and may receive a touch input. At least one laminated element included in the display module 200 may be used as the antenna 230 (typically used for the NFC module 139).

The speaker 102 outputs sound corresponding to electrical signals.

The at least one sensor 103 may measure a physical amount or detect the operating state of the electronic device 100 and convert measured or detected information into electrical signals. The at least one sensor 103 may be mounted at a specific position. The at least one sensor 103 may include at least one of a gesture sensor, a proximity sensor, a grip sensor, a gyro sensor, an acceleration sensor, a geomagnetic sensor, a barometer, a temperature/humidity sensor, a hall sensor, a RGB (red-green-blue) sensor, a illumination sensor, a biophysical sensor, and an ultra violet sensor.

The camera 104 is a device for capturing an image or moving images and may include at least one image sensor, an image signal processor (ISP) (not illustrated), or a flash LED (not illustrated).

The key 105 may include a press key or a touch key. The key 105 may include a key for adjusting volume or a key for turning on or off a power supply.

The external port 106 may be used as a port for connection to a HDMI (high-definition multimedia interface), a USB (universal serial bus) port, a projector, or a D-subminiature cable or a charge port.

The microphone 107 converts sound into electrical signals.

The jack 108 provides an electrical connection with a plug for an earphone or an ear set. The jack 108 may be covered by a cover when not being used.

The antenna 109 (for example, a digital multimedia broadcasting (DMB) antenna) may be exposed outside the electronic device 100 and extend.

Figure 3:
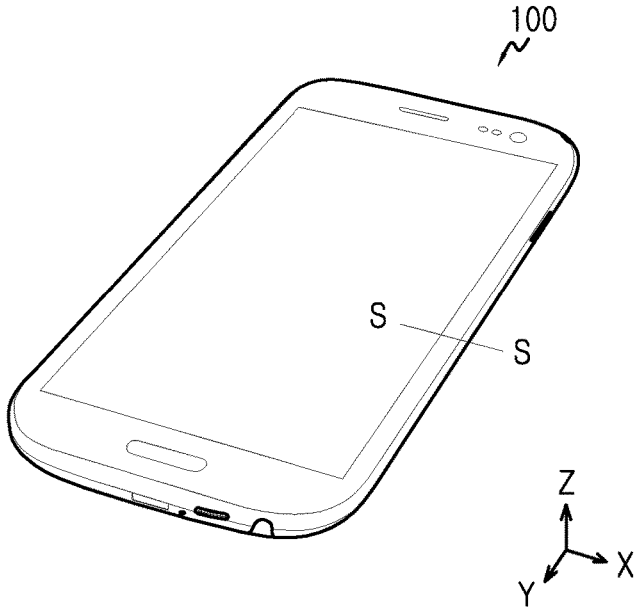
FIG. 3 is a partial cross-sectional view taken along a line S-S of the electronic device according to various embodiments of the present disclosure.
Figure 3:
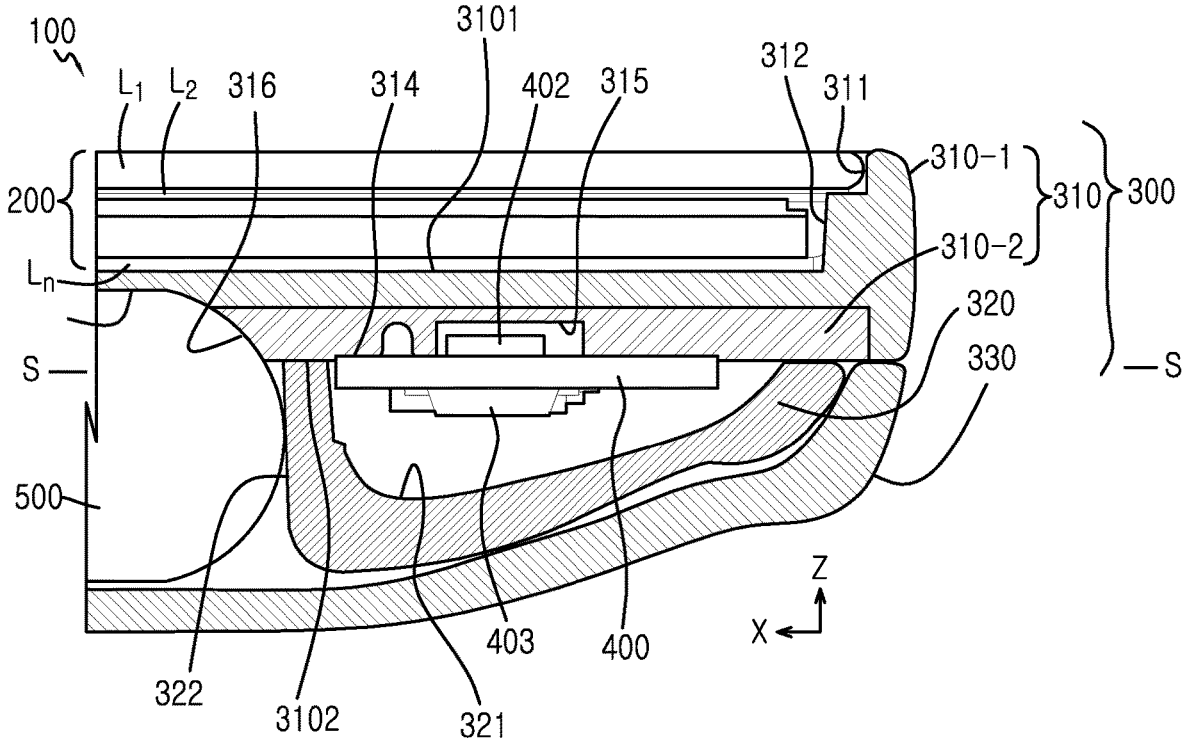

FIG. 3 is a partial cross-sectional view taken along a line S-S of the electronic device 100 according to an example. As shown in FIG. 3, there may be a display module 200, a housing 300, a main circuit board 400 or a battery 500 in a portion corresponding to the line S-S.

The display module 200 may include a plurality "n" of laminated elements $L_1$, $L_2$, . . . Ln. Various exemplary configurations for display module 200 are described herein below with reference to FIGS. 3-11. In general, the following possibilities exist for the laminated elements:

At least one (for example, a window) of laminated elements L1 to Ln may be transparent. For example, a transparent window $L_1$ may be disposed in front of a screen.

At least one of the laminated elements may be a part containing metal (hereafter, referred to as a "metal part").

At least one of laminated elements L1 to Ln may be used to form the touch panel 152, and receive touch inputs. For example, the touch panel 152 may be a layer disposed on one of the layers forming display panel 162. In addition, an electronic writing sheet (for example, a pen sensor 154) that is not illustrated may be disposed under the display panel 162.

At least one of laminated elements L1 to Ln may be used to form a display panel and thereby display an image. For example, the display panel may be disposed under the window. The display panel may be flexible.

At least one of the laminated elements $L_1$ to Ln may include an antenna. For instance, indium tin oxide (ITO) within an element Li forming touch panel 152 may be used to form the antenna (where "Li" is understood to be any of the elements L1 to Ln). The antenna may be disposed above or under the display panel 162.

At least one of laminated elements L1 to Ln may be magnetic or may interact with an electromagnetic field. One example of this type of element is a ferrite sheet. For example, the ferrite sheet may be disposed under the antenna and facilitate stable communication. When the antenna is close to a nearby metal part, such as a metal part serving as a ground surface), the metal part is under the electromagnetic field produced by the antenna. This metal part may reduce the intensity (signal intensity) of the electromagnetic field and disturb the near-field wireless communication of the antenna. Although it is possible to allocate a region of free space between the antenna and the nearby metal part and, therefore, prevent the antenna from being influenced by the nearby metal part, it is difficult to secure the free space between the antenna and the metal part due to limited space in the electronic device 100. The ferrite sheet prevents eddy currents from occurring due to the electromagnetic field of the antenna in the nearby metal part, thereby enabling the effective distance between the antenna and the nearby metal part to appear larger.

At least one of laminated elements L1 to Ln may have a heat-dissipation characteristic. For example, a graphite sheet can be used for this purpose, and may be disposed under the ferrite sheet.

At least one (for example, an electro magnetic interference (EMI) shielding sheet) of laminated elements L1 to Ln may shield electromagnetic noise.

At least one (for example, an impact-absorbing sheet) of laminated elements L1 to Ln may absorb impact.

At least one of the laminated elements may be flexible.

The majority of the laminated elements may be configured as a single module. Examples include any of the window, the touch panel 152, the display panel 162, the pen sensor 162, the antenna, the ferrite sheet, the graphite sheet, the EMI shielding sheet, and the impact-absorbing sheet.

The housing 300 may include a bracket 310, a rear case 320, or a battery cover 330.

The bracket 310 may include an upper bracket 310-1 and a lower bracket 310-2. The lower bracket 310-2 may be fixed to a lower portion of the upper bracket 310-1. The bracket 310 may be a mounting plate in which a plurality of electronic components may be mounted. The bracket 310 may be a frame which fixes or supports a plurality of electronic components (for example, a processor, a memory, a SIM card, an audio codec, a speaker, a receiver, a camera module, an indicator, a motor, a power management module, a battery, a communication module, an user input module, a display module, an interface, or a sensor module). The bracket 310 may be formed of a non-metal material or a metal material. The bracket 310 may include a first surface disposed on the upper side thereof and a second surface disposed on the lower side thereof. The first and second surfaces of the bracket 310 may be mounting surfaces for the mounting of the electronic components. The first surface and/or the second surface of the bracket 310 may include various forms of surfaces, such as a flat surface, a rounded surface, or a sloped surface. The bracket 310 may accommodate the display module 200. The bracket 310 may accommodate a main circuit board 400. The bracket 310 may include a plurality of grooves for accommodating a plurality of components. For example, the bracket 310 may include mounting grooves 311 and 312 for accommodating the display module 200 in an upper portion 3101 thereof. The bracket 310 may include a mounting groove 314 for accommodating the main circuit board 400 in the lower portion 3102 thereof. The bracket 310 may include an electronic component accommodating groove 315 for accommodating electronic components 402 protruding in an upper direction (for example, the direction of the bracket 310) from the main circuit board 500. The bracket 310 may include a container-shaped battery accommodating groove 316 that accommodates a part of the battery 500 and is concave in a lower direction in the lower portion 3102. The bracket 310 may include at least one metal portion (for example, a metal rim or a metal coating) (not illustrated) which may be electrically connected to the ground of the main circuit board 400.

A rear case 320 may be connected to the bracket 310 (for example, using snap-fit fastening or bolt fastening). As another embodiment, the rear case 320 may be formed integrally with the battery cover 330 rather than separately from the battery cover 330. The rear case 320 may cover a plurality of components fixed to the bracket 310. The rear case 320 may cover at least a part of the main circuit board 400 fixed to the bracket 310. The bracket 310, the rear case 320, and the main circuit board 400 may be connected together using a bolt-fastening method. The rear case 320 may include an electronic component accommodating groove 321 for accommodating electronic components 403 protruding in a lower direction (for example, the direction of the rear case 320) from the main circuit board 400. The rear case 320 may include a battery through portion 322 which the battery 500 may pass through. As illustrated, the battery through portion 322 may have an opened structure that penetrates the upper portion and lower portion of the rear case 320 and may be in communication with the container shaped-battery accommodating groove 316 of the bracket 310. When the bracket 310 is connected to the rear case 320, the battery accommodating groove 316 of the bracket 310 and the battery through portion 322 of the rear case 320 may provide a container-shaped space for accommodating the battery 500 entirely. In addition, the battery accommodating groove 316 may have a container shape for accommodating the battery 500 entirely and the battery through portion 322 of the rear case 320 may be unnecessary. In addition, the battery accommodating groove 316 may have a container shape for accommodating the battery 500 entirely and the battery through portion 322 of the rear case 320 may be unnecessary.

The battery cover 330 may be connected to the rear case 320 to form a rear surface of the electronic device 100. The battery cover 330 may include a plurality of hooks (not illustrated) in the rim, which are fastened to a plurality of hook-fastening grooves of the rear case 320.

The main circuit board 400 (for example, a main board or a mother board) may include a substrate in which basic circuits and a plurality of electronic components are mounted. The main circuit board 400 sets an execution environment of the electronic device 100, maintains information thereof, allows electronic device 100 to be stably driven, and allows all units of the electronic device to perform high speed data input/output exchange. For example, the main circuit board 400 may be electrically connected to the display module 200 and control the display module 200. The main circuit board 400 may be connected to the bracket 310 using, for example, a bolt-fastening method.

Figure 4:
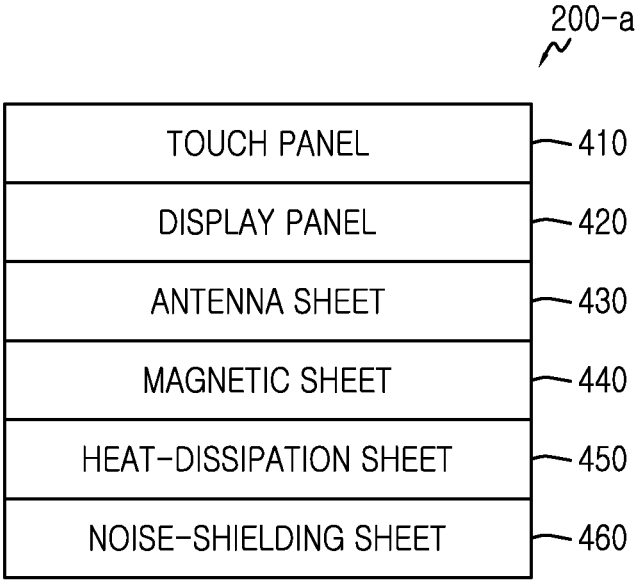
FIG. 4 is a cross-sectional view illustrating a laminated structure of a display module according to an exemplary embodiment.

FIG. 4 is a diagram illustrating a laminated structure of a display module, 200-1, which is an exemplary embodiment of display module 200.

Display module **200-*a* includes a touch panel 410, a display panel 420, an antenna sheet 430, a magnetic sheet 440, a heat-dissipation sheet 450, and a noise-shielding sheet 460**.

The touch panel 410 may receive a touch and output a signal associated with the received touch to a main circuit board 400.

The display panel 420 may be disposed under the touch panel 410 and output an image signal from the main circuit board 400 (shown in FIG. 3).

The antenna sheet 430 includes at least one antenna and is disposed under the display panel 420. The antenna sheet 430 may be used for at least one wireless communication (for example, as part of near field communication (NFC) module 139). At least one antenna of the antenna sheet 430 may be a wire loop type such as the loop structure depicted for the antenna 230 of FIG. 2. At least one antenna of the antenna sheet 430 may be implemented using a flexible printed circuit board (FPCB) or with indium tin oxide. The main circuit board 400 may receive a radio signal from the antenna sheet 430, convert the received radio signal into a baseband signal, and process the baseband signal. The main circuit board 400 may generate a baseband signal, convert the generated baseband signal into a radio signal, and transmits the radio signal into the air through the antenna sheet 430.

The magnetic sheet 440 may be disposed under the antenna sheet 430. The magnetic sheet 440 may be disposed between the antenna sheet 430 and the nearby metal part (or ground). An example of the nearby metal part is a metal portion of the housing 300, the heat-dissipation sheet 450, or the noise-shielding sheet 460. The magnetic sheet 440 induces an electromagnetic field from the antenna sheet 430 and prevents eddy currents from occurring due to the electromagnetic field from the antenna sheet 430 in the nearby metal part. The electromagnetic field is transferred to the magnetic sheet 440 and a high resistance (high permeability or high specific absorption rate) of the magnetic sheet 440 prevents eddy currents from being generated in the nearby metal part. Since eddy currents are not generated in the nearby metal part, the electromagnetic field is concentrated toward the front of the screen (top of the layered structure in FIG. 4) and is not generated in the rear direction, thereby preventing degradation in near-field wireless communication (e.g., NFC communication). That is, the magnetic sheet 440 may enable the electromagnetic field to appear to be far from the nearby metal part. In addition, the magnetic sheet 440 amplifies near field wireless communication signals (for example, NFC signals), thereby enlarging a diameter distance within which signals are receivable from the antenna sheet 430. The magnetic sheet 440 may include ferrite material or a ferrite sheet.

The heat-dissipation sheet 450 (e.g., a graphite sheet) may be disposed under the magnetic sheet 440. In an alternative configuration to that shown in FIG. 4, heat-dissipation sheet 450 may be disposed between the antenna sheet 430 and the magnetic sheet 440 (i.e., directly below the antenna sheet 430). The heat-dissipation sheet 450 uniformly diffuses heat generated from the display module 200 over the entire surface thereof to prevent heat concentration. The heat-dissipation sheet 450 may include a thin-film metal tape having a high thermal conductivity.

The noise-shielding sheet 460 (for example, an EMI shielding sheet, an EMI shielding tape, or EMI shielding paint) may be disposed under the heat-dissipation sheet 450). The noise-shielding sheet 460 may prevent the reception of desired electronic signals from being disturbed by unnecessary electromagnetic signals or electromagnetic noise.

Figure 5A:
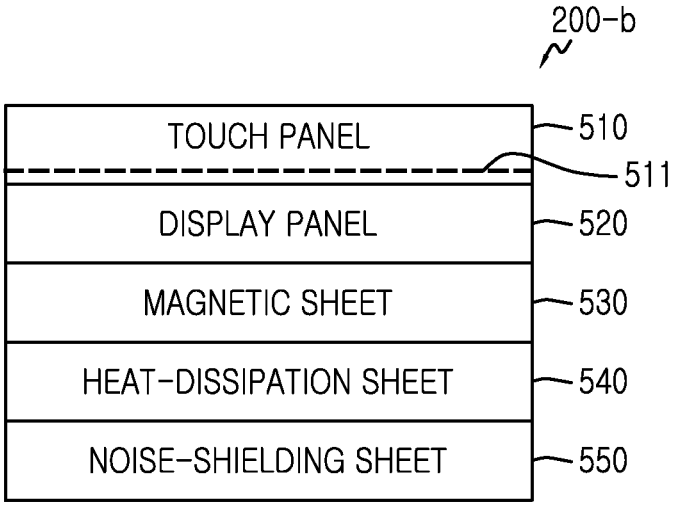
FIG. 5A is a cross-sectional view illustrating a laminated structure of a display module according to another exemplary embodiment.

FIG. 5A is a cross-sectional view illustrating a laminated structure of a display module, 200-*b*, which is another embodiment of display module 200. Display module 200-*b* includes a touch panel 510, a display panel 520, a magnetic sheet 530, a heat-dissipation sheet 540, and a noise-shielding sheet 550. The touch panel 510 may be disposed above the display panel 520. At least one ITO pattern 511 of the touch panel 510 may form an antenna, e.g., for NFC. The display panel 520 may be disposed under the touch panel 510. The magnetic sheet 530 (e.g., ferrite sheet) may be disposed under display panel 520. The magnetic sheet 530 may be disposed between the at least one ITO pattern 511 of the touch panel 510 and the nearby metal part (or ground) (for example, metal in housing 300, the heat-dissipation sheet 540, or the noise-shielding sheet 550).

The heat-dissipation sheet 540 (for example, the graphite sheet) may be disposed under the magnetic sheet 540.

The noise-shielding sheet 550 (for example, an EMI shielding sheet, an EMI shielding tape, or EMI shielding paint) may be disposed under the heat-dissipation sheet 540.

Figure 5B:
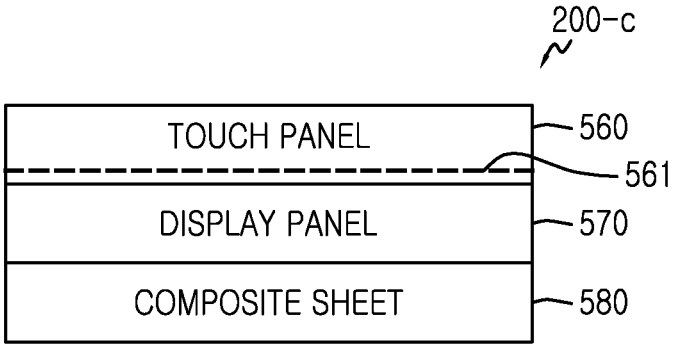
FIG. 5B is a cross-sectional view illustrating a laminated structure of a display module according to yet another exemplary embodiment.

FIG. 5B is a cross-sectional view illustrating a laminated structure of a display module according to yet another example. Display module 200-*c* includes a touch panel 560, a display panel 570, and a composite sheet 580.

The touch panel 560 may be disposed above the display panel 570. At least one ITO 561 of the touch panel 560 may be configured by an antenna.

The display panel 570 may be disposed under the touch panel 560.

The composite sheet 580 may be disposed under the display panel 570. The composite sheet 580 may have different physical or chemical properties or phases according to a combination of various materials to provide a plurality of functions. The composite sheet 580 may be materials made two or more constituent materials with significantly different physical or chemical properties, that when combined, produce a material with characteristics different from the individual components. The composite sheet 580 may have a plurality of physical properties (for example, electrical, magnetic, optical, mechanical or thermal property) specialized for the plurality of functions (for example, electromagnetic induction, heat dissipation, noise shielding, or impact absorption). For example, the composite sheet 580 may have a magnetic property for electromagnetic induction. The composite sheet 580 may a heat-dissipation property for heat dissipation. The composite sheet 580 may have a noise-shielding property for noise shielding. The composite sheet 580 may have an impact absorption property. The composite sheet 580 may have a flexible property for bending.

The composite sheet 580 may be formed in such a way that different types of sheets (for example, a magnetic sheet, a heat-dissipation sheet, or a noise-shielding sheet) are superimposed on each other. For example, the composite sheet 580 can include ferrite material or a ferrite sheet. The ferrite induces an electromagnetic field from at least one ITO 561 pattern used as an antenna (preferably for NFC) and prevents eddy currents from occurring due to the electromagnetic field from the at least one ITO pattern 561. The composite sheet 580 can include a graphite sheet (not illustrated). The graphite sheet uniformly diffuses heat generated from the display module 200 over the entire surface thereof to prevent heat concentration. The ferrite sheet may be disposed above the graphite sheet. The ferrite sheet may alternatively be disposed under the graphite sheet. The composite sheet 580 can also include an EMI shielding sheet which is not illustrated. The EMI shielding sheet may prevent the reception of desired electronic signals from being disturbed by unnecessary electromagnetic signals or electromagnetic noise. The EMI shielding sheet may be disposed above the ferrite sheet or the graphite sheet. The EMI shielding sheet may be alternatively disposed under the ferrite sheet or the graphite sheet. The composite sheet 580 can further include an impact-absorbing sheet (not illustrated). The impact-absorbing sheet may absorb an external impact applied to the display module 200. The impact-absorbing sheet may be disposed above or under the ferrite sheet, the graphite sheet, or the EMI shielding sheet.

Figure 6:
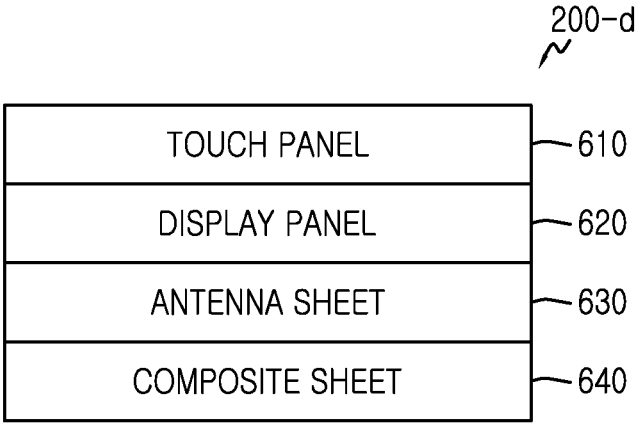
FIG. 6 is a cross-sectional view illustrating a laminated structure of a display module according to a further exemplary embodiment.

FIG. 6 is a cross-sectional view illustrating a laminated structure of a display module, 200-*d*, according to still another example. Display module 200-*d* includes a touch panel 610, a display panel 620, an antenna sheet 630, and a composite sheet 640.

The touch panel 610 is disposed above the display panel 620. Display panel 620 is disposed under the touch panel 610.

The antenna sheet 630 includes at least one antenna and is disposed under the display panel 620. Composite sheet 640 is disposed under the antenna sheet 630. As described above, the composite sheet 640 forms different phases physically and/or chemically according to a combination of various materials to provide a plurality of functions. For example, the composite sheet 640 may be formed in such a way that different types of sheets (for example, a ferrite sheet, a graphite sheet, an EMI shielding sheet, or an impact-absorbing sheet) are superimposed on each other. The composite sheet 640 may have a plurality of physical properties (e.g., electrical, magnetic, optical, mechanical or thermal property) specialized for the plurality of functions (e.g., electromagnetic induction, heat dissipation, noise shielding, or impact absorption). For instance, the composite sheet 640 may have a magnetic property for electromagnetic induction, a heat-dissipation property for heat dissipation, a noise shielding property for noise shielding, and an impact absorption property. The composite sheet 640 may have a flexible property for bending.

The magnetic sheet 640 may induce an electromagnetic field from the antenna sheet 630 and prevent eddy currents from occurring due to the electromagnetic field from the antenna sheet 630 in the nearby metal part.

The composite sheet 640 may uniformly diffuse heat generated from the display module 200 over the entire surface thereof to prevent heat concentration.

The composite sheet 640 may prevent the reception of desired electronic signals from being disturbed by unnecessary electromagnetic signals or electromagnetic noise.

The composite sheet 640 may have a function of absorbing an external impact.

Figure 7:
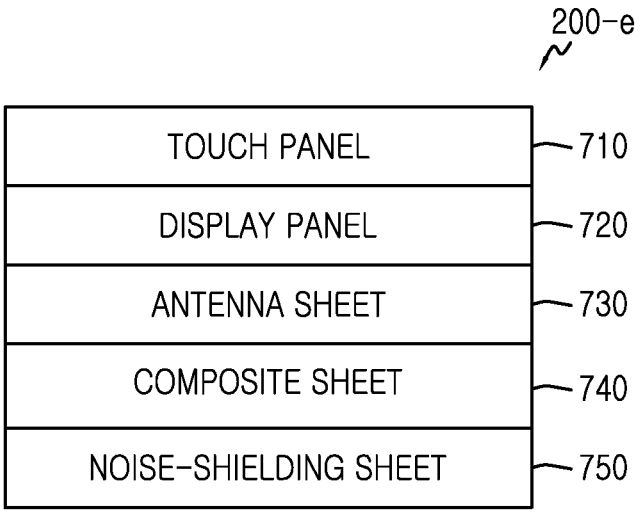
FIG. 7 is a cross-sectional view illustrating a laminated structure of a display module according to an additional exemplary embodiment.

FIG. 7 is a diagram illustrating a laminated structure of a display module 200-*e* according to yet another example. Display module 200-*e* includes a touch panel 710, a display panel 720, an antenna sheet 730, a composite sheet 740, and a noise-shielding sheet 750.

The touch panel 710 may be disposed above the display panel 720. Display panel 720 is disposed under the touch panel 710. Antenna sheet 730 includes at least one antenna and is disposed under the display panel 720

The composite sheet 740 may be disposed under the antenna sheet 730. Composite sheet 740 may include magnetic material which prevents eddy currents from occurring due to an electromagnetic field from the antenna sheet 730 in the nearby metal part. The composite sheet 740 may uniformly diffuse heat generated from the display module 200 over the entire surface thereof to prevent heat concentration. The composite sheet 740 may absorb impact.

The noise-shielding sheet 750 (for example, an EMI shielding sheet) may be disposed under the composite sheet 740.

Figure 8:
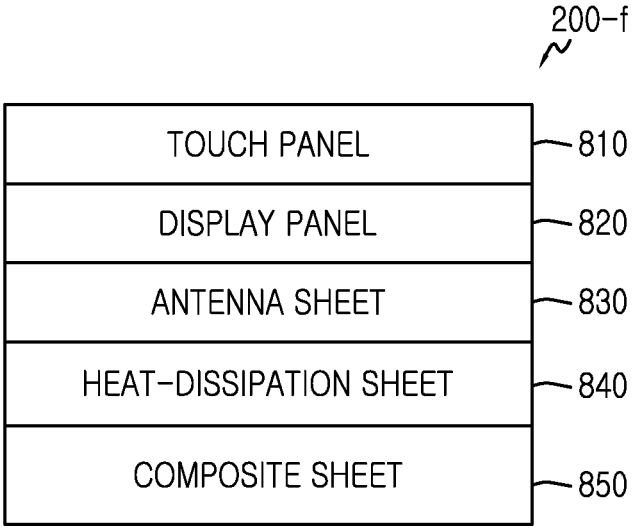
FIG. 8 is a cross-sectional view illustrating a laminated structure of a display module according to still another exemplary embodiment.

FIG. 8 is a cross-sectional view illustrating a laminated structure of a display module, 200-*f*, according to yet another example. Display module 200-*f* includes a touch panel 810, a display panel 820, an antenna sheet 830, a heat-dissipation sheet 840, and a composite sheet 850.

The touch panel 810 is disposed above the display panel 820. Display panel 820 is disposed under the touch panel 810.

The antenna sheet 830 includes at least one antenna and is disposed under the display panel 820 The heat-dissipation sheet 840 (for example, graphite sheet) may be disposed under the antenna sheet 830.

The magnetic sheet 850 may induce an electromagnetic field from the antenna sheet 830 and prevent an eddy current from occurring due to the electromagnetic field from the antenna sheet 830 in a nearby metal part. The composite sheet 850 may prevent the reception of desired electronic signals from being disturbed by unnecessary electromagnetic signals or electromagnetic noise. The composite sheet 850 may absorb external impact.

Figure 9:
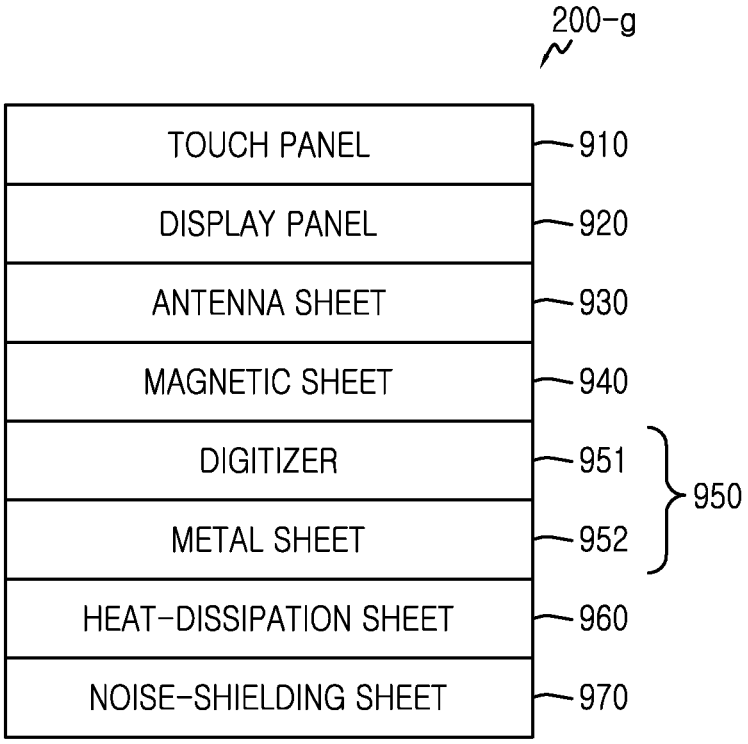
FIG. 9 is a cross-sectional view illustrating a laminated structure of a display module according to yet another exemplary embodiment.

FIG. 9 is a cross-sectional view illustrating a laminated structure of a display module, 200-*g*, according to still another example. Display module 200-*g* includes a touch panel 910, a display panel 920, an antenna sheet 930, a magnetic sheet 940, an electronic writing module 950, a heat-dissipation sheet 960, and a noise-shielding sheet 970.

The touch panel 910 may be disposed above the display panel 920. Display panel 920 is disposed under the touch panel 910.

The antenna sheet 930 may be disposed under the display panel 920. The antenna sheet 930 includes at least one antenna.

The magnetic sheet 940 may be disposed under the antenna sheet 930.

The electronic writing module 950 may include a digitizer 951 (for example, the pen sensor 154) and/or a metal sheet 952. The digitizer 951 may convert analog data into digital format. The digitizer 951 may input a result obtained by reading out the coordinates of a source, such as an image, a figure, or a solid in a digital signal form. The digitizer 951 may include a flexible printed circuit board (FPCB) for recognition of a stylus. The metal sheet 952 may be disposed under the digitizer 951. The metal sheet 952 may stably operate the digitizer 951.

The heat-dissipation sheet 960 (for example, graphite sheet) may be disposed under the metal sheet 952.

The noise-shielding sheet 970 (for example, an EMI shielding sheet) may be disposed under the heat-dissipation sheet 960.

Figure 10:
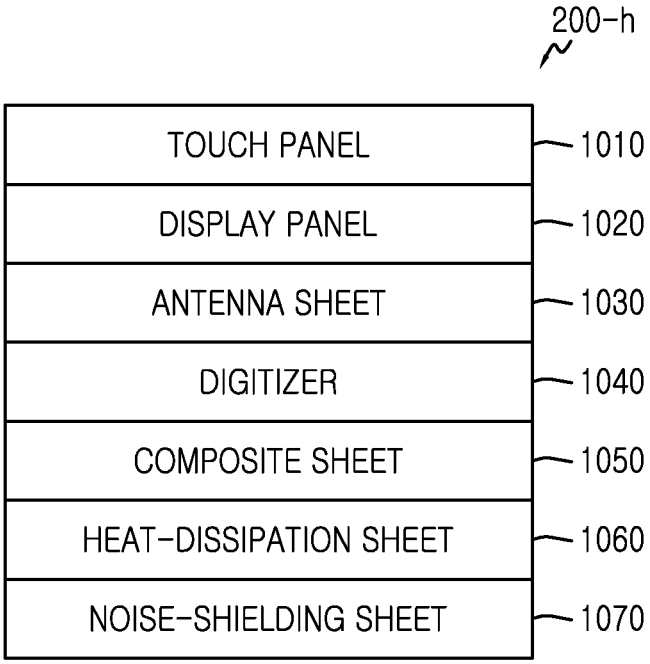
FIG. 10 is a cross-sectional view illustrating a laminated structure of a display module according to yet another exemplary embodiment.

FIG. 10 is a cross-sectional view illustrating a laminated structure of a display module, 200-*h*, according to still another example. Display module 200-*h* includes a touch panel 1010, a display panel 1020, an antenna sheet 1030, a digitizer 1040 (for example, the pen sensor 154), a heat-dissipation sheet 1060, and a noise-shielding sheet 1070.

The touch panel 1010 may be disposed above the display panel 1020.

The display panel 1020 may be disposed under the touch panel 1010.

The antenna sheet 1030 may be disposed under the display panel 1020. The antenna sheet 1030 includes at least one antenna.

The digitizer 1040 (for example, the pen sensor 154) may be disposed under the antenna sheet 1030. The digitizer 1040 may include a FPCB for recognition of a stylus.

The composite sheet 1050 may be disposed under the digitizer 1040. The composite sheet 1050 may include a metal material for table operation of the digitizer 1040. The composite sheet 1050 may induce a magnetic field from the antenna sheet 1030 and prevent eddy currents from occurring due to the magnetic field from the antenna sheet 630 in the nearby metal part. The composite sheet 1050 may absorb external impact.

The heat-dissipation sheet 1060 (for example, graphite sheet) may be disposed under the composite sheet 1050.

The noise-shielding sheet 1070 (for example, an EMI shielding sheet) may be disposed under the heat-dissipation sheet 1060.

Figure 11:
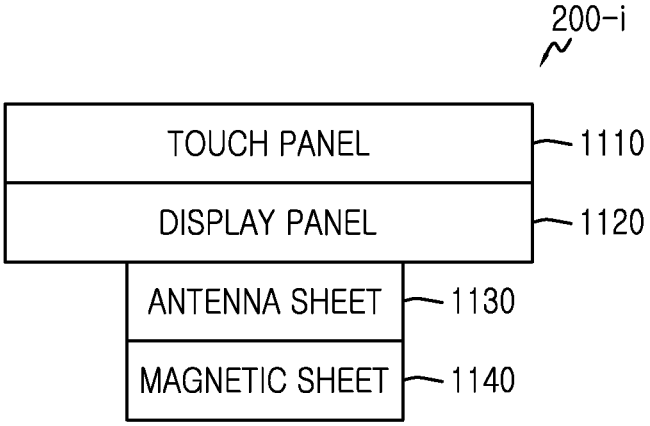
FIG. 11 is a cross-sectional view illustrating a laminated structure of a display module according to yet another exemplary embodiment.

FIG. 11 is a cross-sectional view illustrating a laminated structure of a display module, 200-*i*, according to an additional example. Display module 200-*i* includes a touch panel 1110, a display panel 1120, an antenna sheet 1130, and a magnetic sheet 1140.

The touch panel 1110 may be disposed above the display panel 1120.

The display panel 1120 may be disposed under the touch panel 1110.

The antenna sheet 1130 may be disposed under the display panel 1120. The antenna sheet 1130 and includes at least one antenna. The composite sheet 1130 may be disposed to be superimposed on only a partial area of the display panel 1120.

The magnetic sheet 1140 may be disposed under the antenna sheet 1130. The magnetic sheet 1140 may be disposed to be superimposed on at least a partial area (for example, the entire area of a lower side) of the antenna sheet 1130.

Figure 12:
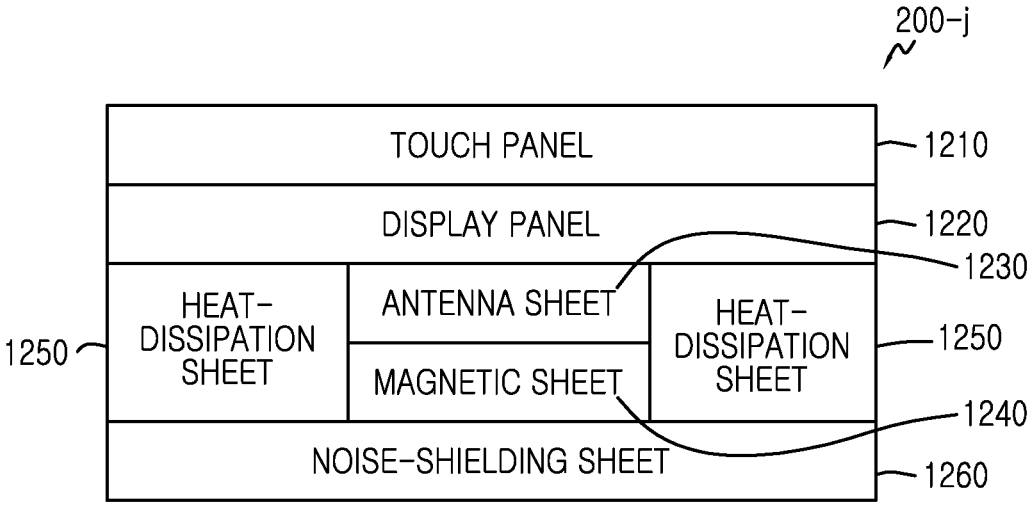
FIG. 12 is a cross-sectional view illustrating a laminated structure of a display module according to yet another exemplary embodiment.

FIG. 12 is a cross-sectional view illustrating a laminated structure of a display module, 200-*j*, according to yet another example. Display module 200-*j* includes a touch panel 1210, a display panel 1220, an antenna sheet 1230, a magnetic sheet 1240, a heat-dissipation sheet 1250, and a noise-shielding sheet 1260.

The touch panel 1210 may be disposed above the display panel 1220.

The display panel 1220 may be disposed under the touch panel 1210.

The antenna sheet 1230 may be disposed superimposed on a partial area of the lower side of the display panel 1220.

The magnetic sheet 1240 may be disposed superimposed on at least a partial area of the lower side of the antenna sheet 1230.

The heat-dissipation sheet 1250 may be disposed superimposed on the remaining area that is not occupied by the antenna sheet 1230 in the lower side of the display panel 1220. The heat-dissipation sheet 1250 may be disposed between the display panel 1220 and the noise-shielding sheet 1260. As illustrated, the heat-dissipation sheet 1250 is disposed perpendicular to the antenna sheet 1230 and to the magnetic sheet 1240, rather than being superimposed with those sheets.

The noise-shielding sheet 1260 may extend to the lower side of the magnetic sheet 1240 and the lower side of the heat-dissipation sheet 1250.

According to various embodiments of the present disclosure, the display module 200 may include a display panel (420, 520, etc.) a magnetic sheet (440, 530, etc.) disposed under the display sheet, and at least one antenna (e.g., antenna sheet 430, ITO pattern 511, etc.) disposed above the magnetic sheet 440.

According to various embodiments of the present disclosure, the antenna (e.g., 430) may be disposed under the display panel (e.g., 420).

According to various embodiments of the present disclosure, the antenna may include a FPCB.

According to various embodiments of the present disclosure, a heat-dissipation sheet may be disposed under the display panel.

According to various embodiments of the present disclosure, a magnetic sheet may be disposed between the antenna and the heat-dissipation sheet.

According to various embodiments of the present disclosure, the heat-dissipation sheet may be disposed between the antenna and the magnetic sheet.

According to various embodiments of the present disclosure, the heat-dissipation sheet may include graphite.

According to various embodiments of the present disclosure, the antenna (for example, the ITO sheet 511) may be disposed under the display panel.

According to various embodiments of the present disclosure, the touch panel is disposed above the display module and the antenna (e.g., ITO antenna 511) may be included in a touch panel.

According to various embodiments of the present disclosure, a noise-shielding sheet (e.g., 460) may be disposed under the magnetic sheet (e.g., 440).

According to various embodiments of the present disclosure, the touch panel may be disposed on the display panel.

According to various embodiments of the present disclosure, a digitizer (e.g., 951) may be disposed under the display panel (e.g., 920).

According to various embodiments of the present disclosure, a metal sheet (e.g. 952) for the digitizer may be disposed under the digitizer (e.g., 951).

According to various embodiments of the present disclosure, the display module (e.g., 200-*f*) may include a display panel (e.g. 820), an antenna sheet (e.g. 830) which is disposed under the display panel and including at least one antenna, and a composite sheet (e.g. 850) which is disposed under the antenna sheet and forms different phases physically according to a combination of various materials to provide a plurality of functions.

According to various embodiments of the present disclosure, the composite sheet may be metallic.

According to various embodiments of the present disclosure, the composite sheet may have a magnetic property for inducing a magnetic field generated from the antenna sheet.

According to various embodiments of the present disclosure, the composite sheet may have a heat-dissipation property for uniformly diffusing heat generated from the display module over the entire surface thereof.

According to various embodiments of the present disclosure, the composite sheet may absorb external impact.

According to various embodiments of the present disclosure, the composite sheet may shield electromagnetic noise.

According to various embodiments of the present disclosure, the touch panel (e.g., 810) may be disposed on, above or directly above the display panel (e.g., 820).

According to various embodiments of the present disclosure, the digitizer (e.g. 1040) may be disposed between the display panel (e.g. 1020) and the composite sheet (e.g. 1050).

According to various embodiments of the present disclosure, the electronic device 100 may include a component mounting plate 310 including at least one metal part, the display module 200 disposed on the component mounting plate 310, and the main circuit board 400 disposed under the component mounting plate 310 and connected to the display module 200. The display module 200 may have an antenna configured by at least one or more laminated elements.

According to the embodiments of the present disclosure, the antenna is configured to include at least one laminated element included in the display module and perform radiation toward the front of the screen, thereby prevention degradation in antenna performance due to at least one metal member (for example, housing) of the electronic device.

While the invention has been shown and described with reference to certain preferred embodiments thereof, it will be understood by those skilled in the art that various changes in form and details may be made therein without departing from the spirit and scope of the invention as defined by the appended claims Therefore, the scope of the invention is defined not by the detailed description of the invention but by the appended claims, and all differences within the scope will be construed as being included in the present invention.

What is claimed is:

1. A display module comprising:

a display panel configured to display images that are visible from above the display module;

a magnetic sheet disposed under a first portion of the display panel at a location overlaying at least a central region of the display module;

a noise-shielding sheet disposed under the magnetic sheet;

at least one transparent Near Field Communication (NFC) antenna disposed above the magnetic sheet; and a heat dissipation sheet is disposed under a second portion of the display panel adjacent to at least one side of the at least one transparent NFC antenna.

2. The display module of claim 1, wherein the at least one transparent NFC antenna includes a flexible printed circuit board (FPCB).

3. The display module of claim 1, wherein the heat-dissipation sheet includes graphite.

4. The display module of claim 1, further comprising a touch panel disposed above the display panel.

5. The display module of claim 1, further comprising a digitizer disposed under the display panel.

6. The display module of claim 5, further comprising a metal sheet for the digitizer disposed under the digitizer.

7. The display module of claim 1, wherein the display panel includes at least one of a thin film transistor liquid crystal display (TFT LCD) panel, a passive-matrix organic light-emitting diode (PM-OLED) panel, and an active-matrix organic light-emitting diode (AM-OLED) panel.

8. The display module of claim 1, wherein the magnetic sheet includes ferrite.

9. A display module comprising:

a display panel configured to display images that are visible from above the display module;

an antenna sheet disposed under a first portion of the display panel at a location overlaying at least a central region of the display module and including at least one transparent Near Field Communication (NFC) antenna within the central region of the display panel;

a heat dissipation sheet is disposed under a second portion of the display panel adjacent to at least one side of the antenna sheet;

a magnetic sheet disposed under the antenna sheet; and a noise-shielding sheet disposed under the magnetic sheet.

10. The display module of claim 9, further comprising a digitizer disposed under the display panel.

11. The display module of claim 9, further comprising a laminate layer at the top of the display module.

12. An electronic device comprising:

a housing;

a component mounting plate including at least one metal part;

a display module disposed on the component mounting plate; and a main circuit board disposed under the component mounting plate and electrically connected to the display module;

wherein, the display module includes a display panel, an antenna sheet having a transparent Near Field Communication (NFC) antenna formed in a pattern within a central region of the display panel, a magnetic sheet, a noise-shielding sheet, and a heat dissipation sheet, and wherein, the antenna sheet is disposed underlaying a first portion of the display panel at a location overlaying at least the central region of the display module within the housing;

the heat dissipation sheet is disposed underlaying a second portion of the display panel adjacent to at least one side of the antenna sheet, the magnetic sheet is disposed under the antenna sheet; and the noise-shielding sheet is disposed under the magnetic sheet.

13. The electronic device of claim 12, wherein the heat dissipation sheet has a first portion disposed adjacent to the antenna sheet and a second portion disposed adjacent to the magnetic sheet.

* * * * *